US009765572B2

(12) United States Patent
Knuteson et al.

(10) Patent No.: US 9,765,572 B2
(45) Date of Patent: Sep. 19, 2017

(54) POLYCRYSTALLINE DIAMOND COMPACT, AND RELATED METHODS AND APPLICATIONS

(71) Applicant: US Synthetic Corporation, Orem, UT (US)

(72) Inventors: Cody William Knuteson, Salem, UT (US); Paul Douglas Jones, Elk Ridge, UT (US); Brandon P. Linford, Draper, UT (US); Brent R. Eddy, Orem, UT (US); Kenneth E. Bertagnolli, Riverton, UT (US); Debkumar Mukhopadhyay, Sandy, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 752 days.

(21) Appl. No.: 14/086,283

(22) Filed: Nov. 21, 2013

(65) Prior Publication Data

US 2015/0136495 A1 May 21, 2015

(51) Int. Cl.
*B24D 3/00* (2006.01)
*B24D 3/02* (2006.01)
(Continued)

(52) U.S. Cl.
CPC ..... *E21B 10/567* (2013.01); *B22F 3/14* (2013.01); *B24D 3/10* (2013.01); *B24D 18/0009* (2013.01);
(Continued)

(58) Field of Classification Search
USPC ..... 51/307, 293, 309
See application file for complete search history.

(56) References Cited

U.S. PATENT DOCUMENTS 3,935,034 A 1/1976 Hayes
4,268,276 A 5/1981 Bovenkerk
(Continued)

FOREIGN PATENT DOCUMENTS

EP 1079063 2/2001
EP 1149937 10/2001
(Continued)

OTHER PUBLICATIONS

U.S. Appl. No. 14/304,631, filed Jun. 13, 2014, Mukhopadhyay et al.
(Continued)

*Primary Examiner* — James McDonough
(74) *Attorney, Agent, or Firm* — Dorsey & Whitney LLP

(57) ABSTRACT

Embodiments relate to polycrystalline diamond compacts ("PDCs") including a polycrystalline diamond ("PCD") table in which a metal-solvent catalyst is alloyed with at least one alloying element to improve thermal stability of the PCD table. In an embodiment, a PDC includes a substrate and a PCD table bonded to the substrate. The PCD table includes diamond grains defining interstitial regions. The PCD table includes an alloy comprising at least one Group VIII metal and at least one metallic alloying element that lowers a temperature at which melting of the at least one Group VIII metal begins. The alloy includes one or more solid solution phases comprising the at least one Group VIII metal and the at least one metallic alloying element and one or more intermediate compounds comprising the at least one Group VIII metal and the at least one metallic alloying element.

37 Claims, 8 Drawing Sheets

(51) Int. Cl.

| | |
|---|---|
| ***B24D 11/00*** | (2006.01) |
| ***B24D 18/00*** | (2006.01) |
| ***C09K 3/14*** | (2006.01) |
| ***E21B 10/567*** | (2006.01) |
| ***B24D 3/10*** | (2006.01) |
| ***E21B 10/55*** | (2006.01) |
| ***E21B 10/573*** | (2006.01) |
| ***C22C 26/00*** | (2006.01) |
| ***B22F 3/14*** | (2006.01) |
| *C22C 29/08* | (2006.01) |
| *B22F 5/00* | (2006.01) |

(52) U.S. Cl.

CPC ..... *C22C 26/00* (2013.01); *E21B 10/55* (2013.01); *E21B 10/5735* (2013.01); *B22F 2005/001* (2013.01); *B22F 2999/00* (2013.01); *C22C 29/08* (2013.01)

(56) References Cited

U.S. PATENT DOCUMENTS

| | | | |
|---|---|---|---|
| 4,274,900 | A | 6/1981 | Mueller et al. |
| 4,410,054 | A | 10/1983 | Nagel et al. |
| 4,468,138 | A | 8/1984 | Nagel |
| 4,560,014 | A | 12/1985 | Geczy |
| 4,738,322 | A | 4/1988 | Hall et al. |
| 4,811,801 | A | 3/1989 | Salesky et al. |
| 4,907,377 | A | 3/1990 | Csillag et al. |
| 4,913,247 | A | 4/1990 | Jones |
| 5,016,718 | A | 5/1991 | Tandberg |
| RE33,767 | E | 12/1991 | Christini et al. |
| 5,092,687 | A | 3/1992 | Hall |
| 5,120,327 | A | 6/1992 | Dennis |
| 5,127,923 | A | 7/1992 | Bunting et al. |
| 5,135,061 | A | 8/1992 | Newton, Jr. |
| 5,154,245 | A | 10/1992 | Waldenstrom et al. |
| 5,364,192 | A | 11/1994 | Damm et al. |
| 5,368,398 | A | 11/1994 | Damm et al. |
| 5,460,233 | A | 10/1995 | Meany et al. |
| 5,480,233 | A | 1/1996 | Cunningham |
| 5,544,713 | A | 8/1996 | Dennis |
| 5,759,216 | A | 6/1998 | Kanada et al. |
| 6,261,329 | B1 | 7/2001 | Ogata et al. |
| 6,338,754 | B1 | 1/2002 | Cannon et al. |
| 6,541,115 | B2 | 4/2003 | Pender et al. |
| 6,793,681 | B1 | 9/2004 | Pope et al. |
| 7,353,893 | B1 | 4/2008 | Hall et al. |
| 7,473,287 | B2 | 1/2009 | Belnap et al. |
| 7,635,035 | B1 | 12/2009 | Bertagnolli et al. |
| 7,647,993 | B2 | 1/2010 | Middlemiss |
| 7,726,421 | B2 | 6/2010 | Middlemiss |
| 7,866,418 | B2 | 1/2011 | Bertagnolli et al. |
| 7,950,477 | B1 | 5/2011 | Bertagnolli et al. |
| 7,998,573 | B2 | 8/2011 | Qian et al. |
| 8,034,136 | B2 | 10/2011 | Sani |
| 8,069,935 | B1 | 12/2011 | Miess et al. |
| 8,080,071 | B1 | 12/2011 | Vail |
| 8,109,349 | B2 | 2/2012 | Hall et al. |
| 8,236,074 | B1 | 8/2012 | Bertagnolli et al. |
| 8,277,722 | B2 | 10/2012 | DiGiovanni |
| 2008/0219914 | A1 | 9/2008 | Smallman et al. |
| 2011/0030283 | A1 | 2/2011 | Cariveau et al. |
| 2012/0012402 | A1 | 1/2012 | Thigpen et al. |
| 2012/0152622 | A1 | 6/2012 | Sue et al. |
| 2012/0241226 | A1 | 9/2012 | Bertagnolli et al. |
| 2012/0261197 | A1* | 10/2012 | Miess ..... B01J 3/062 175/432 |
| 2012/0324801 | A1 | 12/2012 | Fang |
| 2012/0325565 | A1 | 12/2012 | Fang |
| 2013/0067826 | A1 | 3/2013 | Vaughn et al. |
| 2013/0068540 | A1 | 3/2013 | DiGiovanni |
| 2013/0068541 | A1 | 3/2013 | DiGiovanni |
| 2013/0092451 | A1* | 4/2013 | Mukhopadhyay ..... B01J 3/062 175/428 |
| 2013/0092452 | A1 | 4/2013 | Mukhopadhyay et al. |
| 2013/0180181 | A1 | 7/2013 | Nixon et al. |
| 2014/0047776 | A1 | 2/2014 | Scott et al. |
| 2014/0283457 | A1 | 9/2014 | Cariveau et al. |
| 2015/0209745 | A1 | 7/2015 | Mukhopadhyay et al. |
| 2015/0209937 | A1 | 7/2015 | Mukhopadhyay et al. |
| 2015/0211306 | A1 | 7/2015 | Mukhopadhyay et al. |

FOREIGN PATENT DOCUMENTS

| | | |
|---|---|---|
| GB | 376467 | 7/1932 |
| GB | 1496106 | 12/1977 |
| JP | 254042 | 9/1997 |
| JP | 9254042 | 9/1997 |
| WO | WO 2008/062369 | 5/2008 |
| WO | WO 2008/074010 | 6/2008 |
| WO | WO 2012/139060 | 10/2012 |
| WO | WO 2012/173893 | 12/2012 |
| WO | WO 2013/092370 | 6/2013 |

OTHER PUBLICATIONS

U.S. Appl. No. 12/555,715, filed Sep. 8, 2009, Miess et al.
U.S. Appl. No. 13/275,372, filed Oct. 18, 2011, Mukhopadhyay et al.
U.S. Appl. No. 13/751,405, filed Jan. 28, 2013, Gleason.
U.S. Appl. No. 14/677,821, filed Apr. 2, 2015, Mukhopadhyay et al.
U.S. Appl. No. 14/677,859, filed Apr. 2, 2015, Mukhopadhyay et al.
U.S. Appl. No. 14/677,875, filed Apr. 2, 2015, Bertagnolli et al.
Cremer, et al. "Formation of intermetallic cobalt phases in the near surface region of cemented carbides for improved diamond layer deposition," Thin Solid Films 355-356 (2999) pp. 127-133.
Decker et al. "High-Pressure Calibration: A Critical Review," J. Phys. Chem. Ref. Data, 1, 3 (1972).
Guobiao, et al., "Boronizing mechanism of cemented carbides and their wear resistance," Int. Journal of Refractory Metals and Hard Materials, 41 (2013) pp. 351-355.
International Search Report and Written Opinion from International Application No. PCT/US2014/058121 dated Mar. 31, 2015.
Rousse, et al. "Structure of the Intermediate Phase of PbTe at High Pressure," Physical Review B: Condensed Matter and Materials Physics, 71, 224116 (2005).
Ishida et al. "The Co—P (Cobalt-Phosphorus) System" Bulletin of Alloy Phase Diagrams, ASM International, vol. 11, No. 6, Dec. 1, 1990, pp. 555-559.
Partial International Search Report from International Application No. PCT/US2015/034900 mailed Sep. 29, 2015.
Ahmed, et al., "Chemical Vapor Deposition of Diamond Coatings onto Dental Burrs", Journal of Chemical Education, vol. 80, No. 6, Jun. 2003, pp. 636-641.
Ahmed, Waquar, et al., "Chemical Vapor Deposition of Diamond Coatings onto Dental Burrs," Journal of Chemical Education, vol. 80 No. 6, pp. 636-641, Jun. 2003.
International Search Report and Written Opinion from International Application No. PCT/US2015034900 mailed Dec. 10, 2015.
U.S. Appl. No. 14/677,821, Sep. 23, 2016, Office Action.
U.S. Appl. No. 14/677,859, Aug. 3, 2016, Notice of Allowance.
U.S. Appl. No. 14/304,631, Nov. 17, 2016, Restriction Requirement.
Non-Final Office Action for U.S. Appl. No. 14/304,631 mailed Mar. 23, 2017.
Notice of Allowance for U.S. Appl. No. 14/677,821 mailed Mar. 27, 2017.
Supplemental Notice of Allowance received for U.S. Appl. No. 14/677,821 mailed Apr. 14, 2017.

* cited by examiner

POLYCRYSTALLINE DIAMOND COMPACT, AND RELATED METHODS AND APPLICATIONS

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a metal-solvent catalyst to promote intergrowth between the diamond particles, which results in formation of a matrix of bonded diamond grains having diamond-to-diamond bonding therebetween. Interstitial regions between the bonded diamond grains are occupied by the metal-solvent catalyst.

Despite the availability of a number of different PDCs, manufacturers and users of PDCs continue to seek PDCs with improved mechanical properties.

SUMMARY

Embodiments of the invention relate to PDCs including a PCD table in which at least one Group VIII metal is alloyed with at least one alloying element to improve the thermal stability of the PCD table. In an embodiment, a PDC includes a substrate and a PCD table including an upper surface spaced from an interfacial surface that is bonded to the substrate. The PCD table includes a plurality of diamond grains defining a plurality of interstitial regions. The PCD table further includes an alloy comprising at least one Group VIII metal and at least one metallic alloying element that lowers a temperature at which melting of the at least one Group VIII metal begins. The alloy includes one or more solid solution phases comprising the at least one Group VIII metal and the at least one metallic alloying element and one or more intermediate compounds comprising the at least one Group VIII metal and the at least one metallic alloying element. The alloy is disposed in at least a portion of the plurality of interstitial regions. The plurality of diamond grains and the alloy of at least a portion of the PCD table collectively exhibiting a coercivity of about 115 Oersteds ("Oe") or more.

In an embodiment, a method of fabricating a PDC is disclosed. The method includes providing an assembly having a PCD table bonded to a substrate, and at least one material positioned adjacent to the PCD table. The PCD table includes a plurality of bonded diamond grains defining a plurality of interstitial regions, with at least a portion of the plurality of interstitial regions including at least one Group VIII metal disposed therein. The at least one material includes at least one alloying element that lowers a temperature at which melting of the at least one Group VIII metal begins. The method further includes subjecting the assembly to an HPHT process at a first process condition effective to at least partially melt the at least one alloying element of the at least one material and alloy the at least one Group VIII metal with the at least one alloying element to form an alloy that includes one or more solid solution phases comprising the at least one Group VIII metal and the at least one metallic alloying element and one or more intermediate compounds comprising the at least one Group VIII metal and the at least one metallic alloying element. The plurality of diamond grains and the alloy of at least a portion of the polycrystalline diamond table collectively exhibiting a coercivity of about 115 Oe or more.

Other embodiments include applications utilizing the disclosed PDCs in various articles and apparatuses, such as rotary drill bits, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments of the invention relate to PDCs including a PCD table in which at least one Group VIII metal is alloyed with at least one alloying element to improve the thermal stability of the PCD table. The disclosed PDCs may be used in a variety of applications, such as rotary drill bits, machining equipment, and other articles and apparatuses.

Figure 1A:
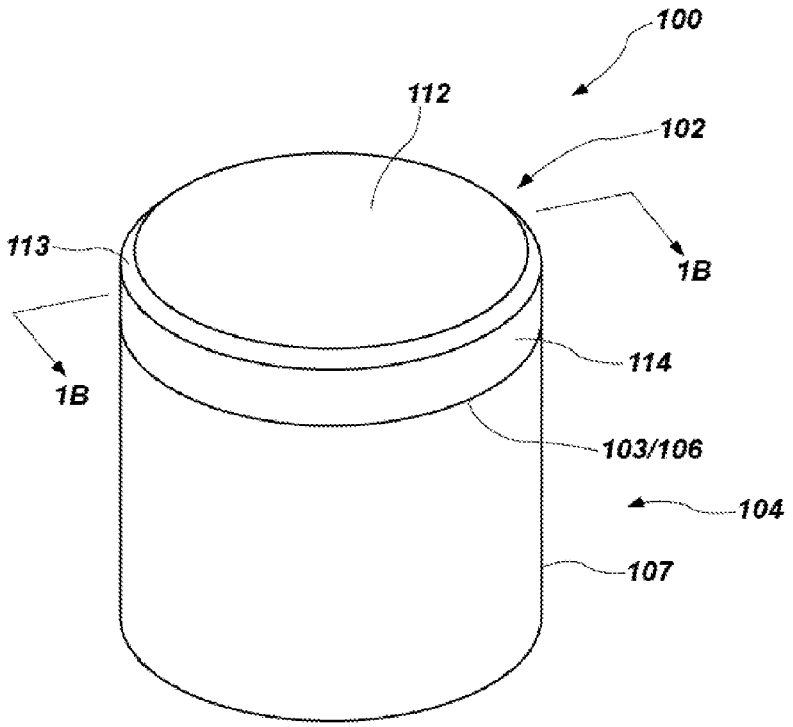
FIG. 1A is an isometric view of an embodiment of a PDC.
Figure 1B:
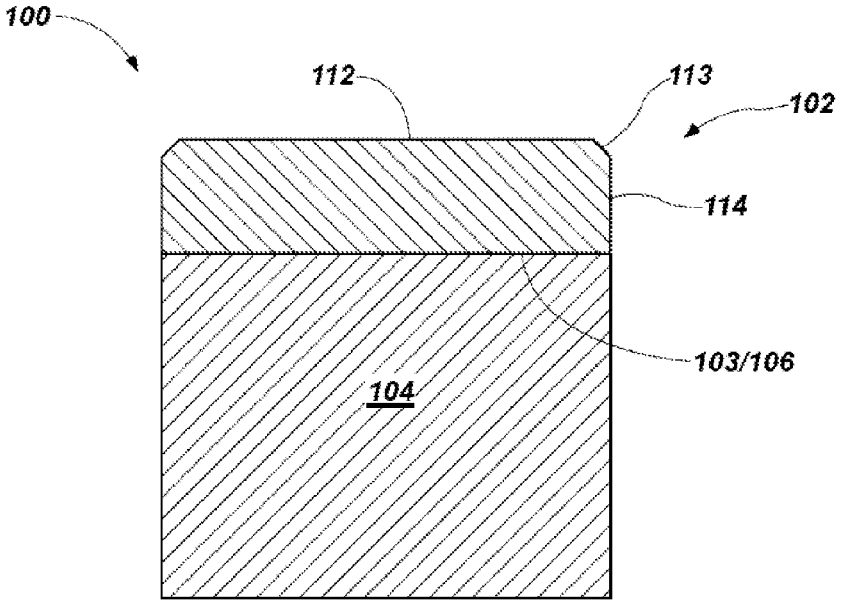
FIG. 1B is a cross-sectional view of the PDC shown in FIG. 1A taken along line 1B-1B thereof.

FIGS. 1A and 1B are isometric and cross-sectional views, respectively, of an embodiment of a PDC 100. The PDC 100 includes a PCD table 102 having an interfacial surface 103, and a substrate 104 having an interfacial surface 106 that is bonded to the interfacial surface 103 of the PCD table 102. The substrate 104 may comprise, for example, a cemented carbide substrate, such as tungsten carbide, tantalum carbide, vanadium carbide, niobium carbide, chromium carbide, titanium carbide, or combinations of the foregoing carbides cemented with iron, nickel, cobalt, or alloys thereof. In an embodiment, the cemented carbide substrate comprises a cobalt-cemented tungsten carbide substrate. While the PDC 100 is illustrated as being generally cylindrical, the PDC 100 may exhibit any other suitable geometry and may be non-cylindrical. Additionally, while the interfacial surfaces 103 and 106 are illustrated as being substantially planar, the interfacial surfaces 103 and 106 may exhibit complementary non-planar configurations.

The PCD table 102 may be integrally formed with the substrate 104. For example, the PCD table 102 may be integrally formed with the substrate 104 in an HPHT process by sintering of diamond particles on the substrate 104. The PCD table 102 further includes a plurality of directly bonded-together diamond grains exhibiting diamond-to-diamond bonding (e.g., $sp^3$ bonding) therebetween. The plurality of directly bonded-together diamond grains define a plurality of interstitial regions. For example, the diamond grains of the PCD table 102 may exhibit an average grain size of about less than 40 μm, about less than 30 μm, about 18 μm to about 30 μm, or about 18 μm to about 25 μm (e.g., about 19 μm to about 21 μm). The PCD table 102 defines the working upper surface 112, at least one side surface 114, and an optional peripherally-extending chamfer 113 that extends between the at least one side surface 114 and the working upper surface 112.

A metallic interstitial constituent is disposed in at least a portion of the interstitial regions of the PCD table 102. In an embodiment, the metallic interstitial constituent includes and/or is formed from an alloy that is chosen to exhibit a selected melting temperature or melting temperature range and bulk modulus that are sufficiently low so that it does not break diamond-to-diamond bonds between bonded diamond grains during heating experienced during use, such as cutting operations. During cutting operations using the PCD table 102, the relatively deformable metallic interstitial constituent may potentially extrude out of the PCD table 102. However, before, during, and after the cutting operations, the PCD table 102 still includes the metallic interstitial constituent distributed substantially entirely throughout the PCD table 102.

According to various embodiments, the alloy comprises at least one Group VIII metal including cobalt, iron, nickel, or alloys thereof and at least one alloying element selected from silver, gold, aluminum, antimony, boron, carbon, cerium, chromium, copper, dysprosium, erbium, iron, gallium, germanium, gadolinium, hafnium, holmium, indium, lanthanum, magnesium, manganese, molybdenum, niobium, neodymium, nickel, praseodymium, platinum, ruthenium, sulfur, antimony, scandium, selenium, silicon, samarium, tin, tantalum, terbium, tellurium, thorium, titanium, vanadium, tungsten, yttrium, zinc, zirconium, and any combination thereof. For example, a more specific group for the alloying element includes boron, copper, gallium, germanium, gadolinium, silicon, tin, zinc, zirconium, and combinations thereof. The alloying element may be present with the at least one Group VIII metal in an amount at a eutectic composition, hypo-eutectic composition, or hyper-eutectic composition for the at least one Group VIII-alloying element chemical system if the at least one Group VIII-alloying element has a eutectic composition. The alloying element may lower a melting temperature of the at least one Group VIII metal, a bulk modulus of the at least one Group VIII metal, a coefficient of thermal expansion of the at least one Group VIII metal, or any combination thereof.

The at least one Group VIII metal may be infiltrated from the cementing constituent of the substrate 104 (e.g., cobalt from a cobalt-cemented tungsten carbide substrate) and alloyed with the alloying element provided from a source other than the substrate 104. In such an embodiment, a depletion region of the at least one Group VIII metal in the substrate 104 in which the concentration of the at least one Group VIII metal is less than the concentration prior to being bonded to the PCD table 102 may be present at and near the interfacial surface 106. In such an embodiment, the at least one Group VIII metal may form and/or carry tungsten and/or tungsten carbide with it during infiltration into the diamond particles being sintered that, ultimately, forms the PCD table 102.

Depending on the alloy system, in some embodiments, the alloy disposed interstitially in the PCD table 102 comprises one or more solid solution alloy phases of the at least one Group VIII metal and the alloying element, one or more intermediate compound phases (e.g., one or more intermetallic compounds) between the alloying element and the at least one Group VIII metal and/or other metal (e.g., tungsten) to form one or more binary or greater intermediate compound phases, one or more carbide phases between the alloying element, carbon, and optionally other metal(s), or combinations thereof. In some embodiments, when the one or more intermediate compounds are present in the alloy, the one or more intermediate compounds are present in an amount less than about 15 weight % of the alloy, such as less than about 10 weight %, about 5 weight % to about 10 weight %, about 1 weight % to about 4 weight %, or about 1 weight % to about 3 weight %, with the balance being the one or more solid solution phases and/or one or more carbide phases. In other embodiments, when the one or more intermediate compounds are present in the alloy, the one or more intermediate compounds are present in the alloy in an amount greater than about 90 weight % of the alloy, such as about 90 weight % to about 100 weight %, about 90 weight % to about 95 weight %, about 90 weight % to about 97 weight %, about 92 weight % to about 95 weight %, about 97 weight % to about 99 weight %, or about 100 weight % (i.e., substantially all of the alloy). That is, the alloy is a multi-phase alloy that may include one or more solid solution alloy phases, one or more intermediate compound phases, one or more carbide phases, or combinations thereof. The inventors currently believe that the presence of the one or more intermediate compounds may enhance the thermal stability of the PCD table 102 due to the relatively lower coefficient of thermal expansion of the one or more intermediate compounds compared to a pure Group VIII metal, such as cobalt. Additionally, the inventors currently believe that the presence of the solid solution alloy of the at least one Group VIII metal may enhance the thermal stability of the PCD table 102 due to lowering of the melting temperature and/or bulk modulus of the at least one Group VIII metal.

For example, when the at least one Group VIII element is cobalt and the at least one alloying element is boron, the alloy may include WC phase, $Co_AW_BB_C$ (e.g., $Co_{21}W_2B_6$) phase, $Co_DB_E$ (e.g., $Co_2B$ or $BCo_2$) phase, and Co phase (e.g., substantially pure cobalt or a cobalt solid solution phase) in various amounts. According to one or more embodiments, the WC phase may be present in the alloy in an amount less than 1 weight %, or less than 3 weight %; the $Co_AW_BB_C$ (e.g., $Co_{21}W_2B_6$) phase may be present in the alloy in an amount less than 1 weight %, about 2 weight % to about 5 weight %, more than 10 weight %, about 5 weight % to about 10 weight %, or more than 15 weight %; the $Co_DB_E$ (e.g., $Co_2B$ or $BCo_2$) phase may be present in the alloy in an amount greater than about 1 weight %, greater than about 2 weight %, or about 2 weight % to about 5 weight %; and the Co phase (e.g., substantially pure cobalt or a cobalt solid solution phase) may be present in the alloy in an amount less than 1 weight %, or less than 3 weight %. Any combination of the recited concentrations for the foregoing phases may be present in the alloy. In some embodiments, the maximum concentration of the $Co_{21}W_2B_6$ may occur at an intermediate depth below the working upper surface 112 of the PCD table 102, such as about 0.010 inches to about 0.040 inches, about 0.020 inches to about 0.040 inches, or about 0.028 inches to about 0.035 inches (e.g., about 0.030 inches) below the working upper surface 112 of the PCD table. In the region of the PCD table 102 that has the maximum concentration of the $Co_{21}W_2B_6$ phase, the diamond content of the PCD table may be less that 90 weight %, such as about 80 weight % to about 85 weight %, or about 81 weight % to about 84 weight % (e.g., about 83 weight %).

Table I below lists various different embodiments for the alloy of the interstitial constituent. For some of the alloying elements, the eutectic composition with cobalt and the corresponding eutectic temperature at 1 atmosphere is also listed. As previously noted, in such alloys, in some embodiments, the alloying element may be present at a eutectic composition, hypo-eutectic composition, or hyper-eutectic composition for the cobalt-alloying element chemical system.

TABLE I

| Alloying Element | Melting Point (° C.) | Eutectic Composition (atomic %) | Eutectic Temperature (° C.) |
|---|---|---|---|
| Silver (Ag) | 960.8 | N/A | N/A |
| Aluminum (Al) | 660 | N/A | N/A |
| Gold (Au) | 1063 | N/A | N/A |

TABLE I-continued

| Alloying Element | Melting Point (° C.) | Eutectic Composition (atomic %) | Eutectic Temperature (° C.) |
|---|---|---|---|
| Boron (B) | 2030 | 18.5 | 1100 |
| Bismuth (Bi) | 271.3 | N/A | N/A |
| Carbon (C) | 3727 | 11.6 | 1320 |
| Cerium (Ce) | 795 | 76 | 424 |
| Chromium (Cr) | 1875 | 44 | 1395 |
| Copper (Cu) | 1085 | N/A | N/A |
| Dysprosium (Dy) | 1409 | 60 | 745 |
| Erbium (Er) | 1497 | 60 | 795 |
| Iron (Fe) | 1536 | N/A | N/A |
| Gallium (Ga) | 29.8 | 80 | 855 |
| Germanium (Ge) | 937.4 | 75 | 817 |
| Gadolinium (Gd) | 1312 | 63 | 645 |
| Halfnium (Hf) | 2222 | 76 | 1212 |
| Holmium (Ho) | 1461 | 67 | 770 |
| Indium (In) | 156.2 | 23 | 1286 |
| Lanthanum (La) | 920 | 69 | 500 |
| Magnesium (Mg) | 650 | 98 | 635 |
| Manganese (Mn) | 1245 | 36 | 1160 |
| Molybdenum (Mo) | 2610 | 26 | 1335 |
| Niobium (Nb) | 2468 | 86.1 | 1237 |
| Neodymium (Nd) | 1024 | 64 | 566 |
| Nickel (Ni) | 1453 | N/A | N/A |
| Praseodymium (Pr) | 935 | 66 | 560 |
| Platinum (Pt) | 1769 | N/A | N/A |
| Ruthenium (Ru) | 2500 | N/A | N/A |
| Sulfur (S) | 119 | 41 | 822 |
| Antimony (Sb) | 630.5 | 97 | 621 |
| Scandium (Sc) | 1539 | 71.5 | 770 |
| Selenium (Se) | 217 | 44.5 | 910 |
| Silicon (Si) | 1410 | 23 | 1195 |
| Samarium (Sm) | 1072 | 64 | 575 |
| Tin (Sn) | 231.9 | N/A | N/A |
| Tantalum (Ta) | 2996 | 13.5 | 1276 |
| Terbium (Tb) | 1356 | 62.5 | 690 |
| Tellurium (Te) | 449.5 | 48 | 980 |
| Thorium (Th) | 1750 | 38 | 960 |
| Titanium (Ti) | 1668 | 76.8 | 1020 |
| Vanadium (V) | 1900 | N/A | N/A |
| Tungsten (W) | 3410 | N/A | N/A |
| Yttrium (Y) | 1409 | 63 | 738 |
| Zinc (Zn) | 419.5 | N/A | N/A |
| Zirconium (Zr) | 1852 | 78.5 | 980 |

In a more specific embodiment, the alloy includes cobalt for the at least one Group VIII metal and zinc for the alloying element. For example, the alloy of cobalt and zinc may include a cobalt solid solution phase of cobalt and zinc and/or a cobalt-zinc intermetallic phase. In another embodiment, the alloy includes cobalt for the at least one Group VIII metal and zirconium for the alloying element. In a further embodiment, the alloy includes cobalt for the at least one Group VIII metal and copper for the alloying element. In some embodiments, the alloying element is a carbide former, such as aluminum, niobium, silicon, tantalum, or titanium. In some embodiments, the alloying element may be a non-carbon metallic alloying element, such as any of the metals listed in the table above. In other embodiments, the alloying element may not be a carbide former or may not be a strong carbide former compared to tungsten. For example, copper and zinc are examples of the alloying element that are not strong carbide formers. For example, in another embodiment, the alloy includes cobalt for the at least one Group VIII metal and boron for the alloying element. In such an embodiment, the metallic interstitial constituent may include a number of different intermediate compounds, such as BCo, $W_2B_5$, $B_2CoW_2$, $Co_2B$, WC, $Co_{21}W_2B_6$, $Co_3W_3C$, $CoB_2$, $CoW_2B_2$, CoWB, combinations thereof, along with some pure cobalt. It should be noted that despite the presence of boron in the alloy, the alloy may be substantially free of boron carbide in some embodiments but include tungsten carbide with the tungsten provided from the substrate 104 during the sweep through of the at least one Group VIII metal into the PCD table 102 during formation thereof.

Depending on the HPHT processing technique used to form the PDC 100, the alloy disposed in the interstitial regions of the PCD table 102 may exhibit a composition that is substantially uniform throughout the PCD table 102. In other embodiments, the composition of the alloy disposed in the interstitial regions of the PCD table 102 may exhibit a gradient in which the concentration of the alloying element decreases with distance away from the working upper surface 112 of the PCD table 102 toward the substrate 104. In such an embodiment, if present at all, the alloy may exhibit a decreasing concentration of any intermediate compounds with distance away from the working upper surface 112 of the PCD table 102.

The alloy of the PCD table 102 may be selected from a number of different alloys exhibiting a melting temperature of about 1400° C. or less and a bulk modulus at 20° C. of about 150 GPa or less. As used herein, melting temperature refers to the lowest temperature at which melting of a material begins at standard pressure conditions (i.e., 100 kPa). For example, depending upon the composition of the alloy, the alloy may melt over a temperature range such as occurs when the alloy has a hypereutectic composition or a hypoeutectic composition where melting begins at the solidus temperature and is substantially complete at the liquidus temperature. In other cases, the alloy may have a single melting temperature as occurs in a substantially pure metal or a eutectic alloy.

In one or more embodiments, the alloy exhibits a coefficient of thermal expansion of about $3\times10^{-6}$ per ° C. to about $20\times10^{-6}$ per ° C., a melting temperature of about 180° C. to about 1300° C., and a bulk modulus at 20° C. of about 30 GPa to about 150 GPa; a coefficient of thermal expansion of about $15\times10^{-6}$ per ° C. to about $20\times10^{-6}$ per ° C., a melting temperature of about 180° C. to about 1100° C., and a bulk modulus at 20° C. of about 50 GPa to about 130 GPa; a coefficient of thermal expansion of about $15\times10^{-6}$ per ° C. to about $20\times10^{-6}$ per ° C., a melting temperature of about 950° C. to about 1100° C. (e.g., 1090° C.), and a bulk modulus at 20° C. of about 120 GPa to about 140 GPa (e.g., about 130 GPa); or a coefficient of thermal expansion of about $15\times10^{-6}$ per ° C. to about $20\times10^{-6}$ per ° C., a melting temperature of about 180° C. to about 300° C. (e.g., about 250° C.), and a bulk modulus at 20° C. of about 45 GPa to about 55 GPa (e.g., about 50 GPa). For example, the alloy may exhibit a melting temperature of less than about 1200° C. (e.g., less than about 1100° C.) and a bulk modulus at 20° C. of less than about 140 GPa (e.g., less than about 130 GPa). For example, the alloy may exhibit a melting temperature of less than about 1200° C. (e.g., less than 1100° C.), and a bulk modulus at 20° C. of less than about 130 GPa.

When the HPHT sintering pressure is greater than about 7.5 GPa cell pressure, optionally in combination with the average diamond grain size being less than about 30 μm, any portion of the PCD table 102 (prior to being leached) defined collectively by the bonded diamond grains and the alloy may exhibit a coercivity of about 115 Oe or more and the alloy content in the PCD table 102 may be less than about 7.5% by weight as indicated by a specific magnetic saturation of about 15 $G\cdot cm^3/g$ or less. In another embodiment, the coercivity may be about 115 Oe to about 250 Oe and the specific magnetic saturation of the PCD table 102 (prior to being leached) may be greater than 0 $G\cdot cm^3/g$ to about 15 $G\cdot cm^3/g$. In another embodiment, the coercivity may be about 115 Oe to about 175 Oe and the specific magnetic saturation of the PCD may be about 5 $G\cdot cm^3/g$ to about 15 $G\cdot cm^3/g$. In yet another embodiment, the coercivity of the PCD table (prior to being leached) may be about 155 Oe to about 175 Oe and the specific magnetic saturation of the first region 114 may be about 10 $G\cdot cm^3/g$ to about 15 $G\cdot cm^3/g$. The specific permeability (i.e., the ratio of specific magnetic saturation to coercivity) of the PCD table 102 may be about 0.10 $G\cdot cm^3/g\cdot Oe$ or less, such as about 0.060 $G\cdot cm^3/g\cdot Oe$ to about 0.090 $G\cdot cm^3/g\cdot Oe$. In some embodiments, the average grain size of the bonded diamond grains may be less than about 30 μm and the alloy content in the PCD table 102 (prior to being leached) may be less than about 7.5% by weight (e.g., about 1% to about 6% by weight, about 3% to about 6% by weight, or about 1% to about 3% by weight). Additionally details about magnetic properties that the PCD table 102 may exhibit is disclosed in U.S. Pat. No. 7,866,418, the disclosure of which is incorporated herein, in its entirety, by this reference.

Figure 2:
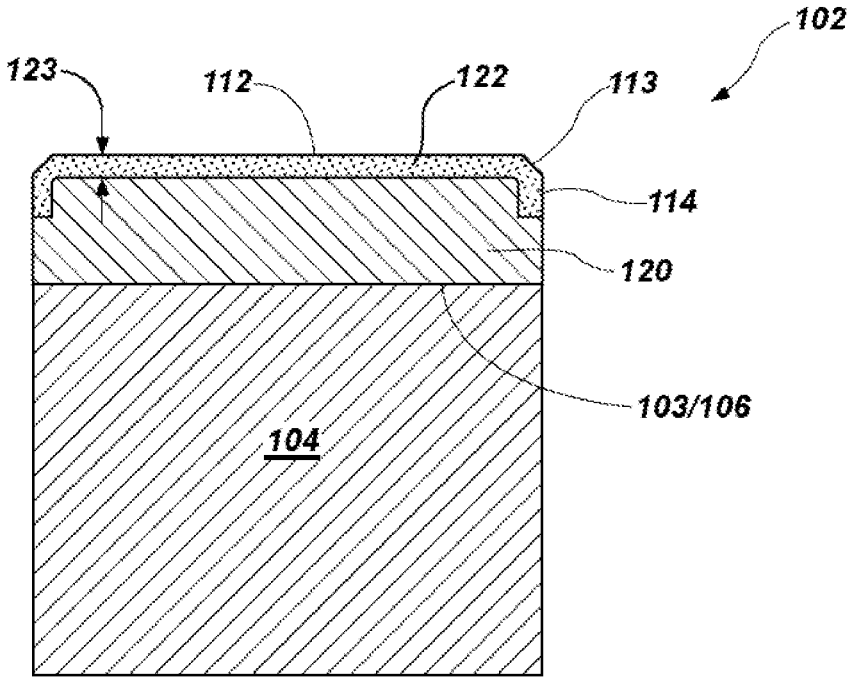
FIG. 2 is a cross-sectional view of another embodiment in which the PCD table shown in FIGS. 1A and 1B is leached to deplete the metallic interstitial constituent from a leached region thereof.

Referring specifically to the cross-sectional view of FIG. 2, in an embodiment, the PCD table 102 may be leached to improve the thermal stability thereof. The PCD table 102 includes a first region 120 adjacent to the interfacial surface 106 of the substrate 104. The metallic interstitial constituent occupies at least a portion of the interstitial regions of the first region 120 of the PCD table 102. For example, the metallic interstitial constituent may be any of the alloys discussed herein. The PCD table 102 also includes a leached second region 122 remote from the substrate 104 that includes the upper surface 112, the chamfer 113, and a portion of the at least one side surface 114. The leached second region 122 extends inwardly to a selected depth or depths from the upper surface 112, the chamfer 113, and a portion of the at least one side surface 114.

The leached second region 122 has been leached to deplete the metallic interstitial constituent therefrom that previously occupied the interstitial regions between the bonded diamond grains of the leached second region 122. The leaching may be performed in a suitable acid (e.g., aqua regia, nitric acid, hydrofluoric acid, or combinations thereof) so that the leached second region 122 is substantially free of the metallic interstitial constituent. As a result of the metallic interstitial constituent (e.g., cobalt) being depleted from the leached second region 122, the leached second region 122 is relatively more thermally stable than the underlying first region 120.

Generally, a maximum leach depth 123 may be greater than 250 μm. For example, the maximum leach depth 123 for the leached second region 122 may be about 300 μm to about 425 μm, about 250 μm to about 400 μm, about 350 μm to about 400 μm, about 350 μm to about 375 μm, about 375 μm to about 400 μm, or about 500 μm to about 650 μm. The maximum leach depth 123 may be measured inwardly from at least one of the upper surface 112, the chamfer 113, or the at least one side surface 114.

Figure 3A:
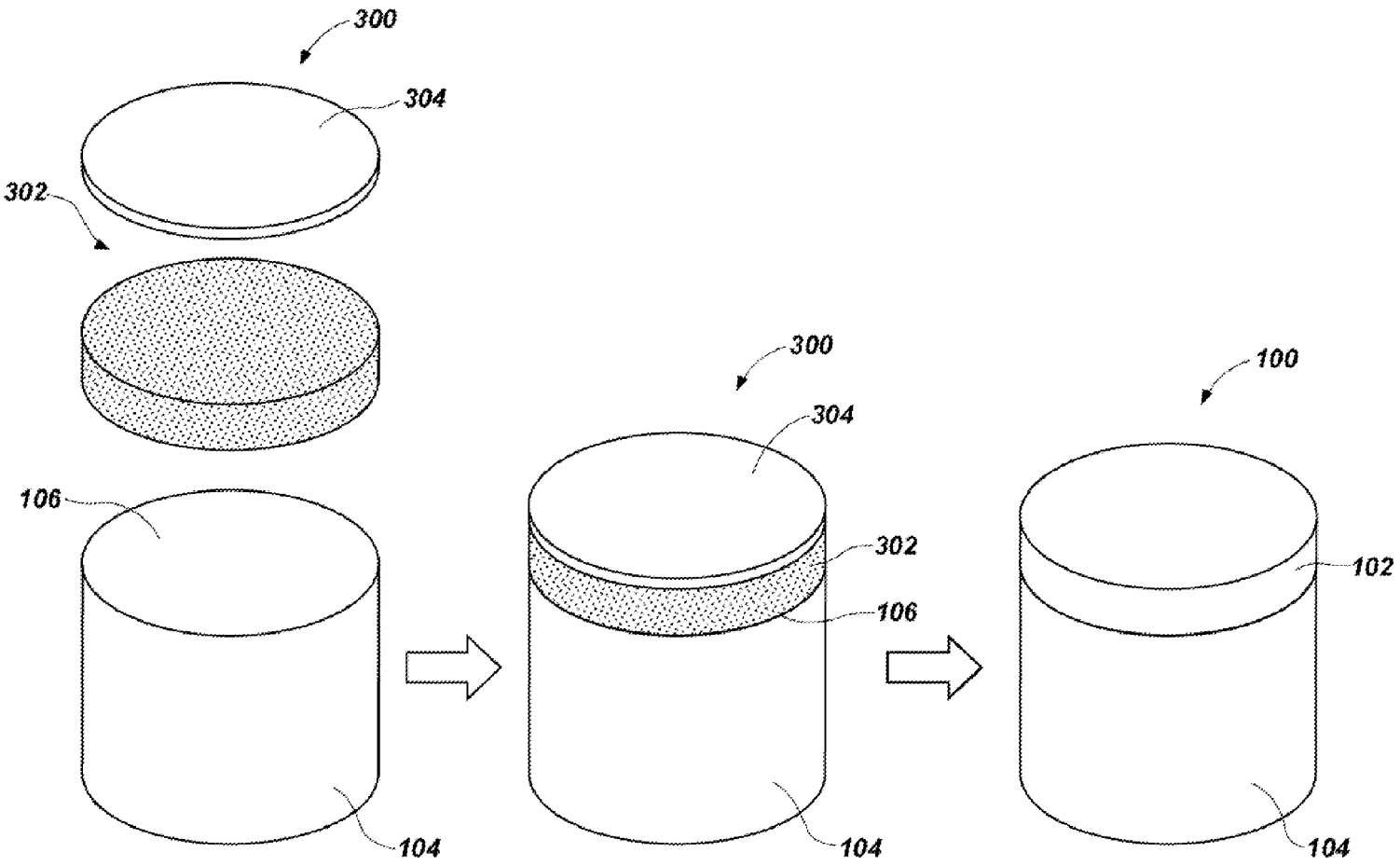
FIG. 3A is a schematic diagram at different stages during the fabrication of the PDC shown in FIGS. 1A and 1B according to an embodiment of a method.

FIG. 3A is a schematic diagram at different stages during the fabrication of the PDC 100 shown in FIGS. 1A and 1B according to an embodiment of a method. Referring to FIG. 3A, an assembly 300 including a mass of diamond particles 302 is positioned between the interfacial surface 106 of the substrate 104 and at least one material 304 that includes any of the alloying elements disclosed herein (e.g., at least one alloying element that lowers a temperature at which melting of at least one Group VIII metal begins and exhibits a melting temperature greater than that of the melting temperature of the at least one Group VIII metal). For example, the at least one material 304 may be in the form of particles of the alloying element(s), a thin disc of the alloying element(s), a green body of particles of the alloying elements(s), at least one material of the alloying element(s), or combinations thereof. In some embodiments, the at least one alloying element may even comprise carbon in the form of at least one of graphite, graphene, fullerenes, or other $sp^2$-carbon-containing particles. As previously discussed, the substrate 104 may include a metal-solvent catalyst as a cementing constituent comprising at least one Group VIII metal, such as cobalt, iron, nickel, or alloys thereof. For example, the substrate 104 may comprise a cobalt-cemented tungsten carbide substrate in which cobalt is the at least one Group VIII metal that serves as the cementing constituent.

The diamond particles may exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). In various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively larger size between about 40 μm and about 15 μm and another portion exhibiting a relatively smaller size between about 12 μm and 2 μm. Of course, the diamond particles may also include three or more different sizes (e.g., one relatively larger size and two or more relatively smaller sizes), without limitation.

The assembly 300 may be placed in a pressure transmitting medium, such as a refractory metal can embedded in pyrophyllite or other pressure transmitting medium, and subjected to a first stage HPHT process. For example, the first stage HPHT process may be performed using an ultra-high pressure press to create temperature and pressure conditions at which diamond is stable. The temperature of the first stage HPHT process may be at least about 1000° C. (e.g., about 1200° C. to about 1600° C.) and the pressure of the HPHT process may be at least 4.0 GPa (e.g., about 5.0 GPa to about 12 GPa or about 7.5 GPa to about 11 GPa) for a time sufficient to sinter the diamond particles to form a PCD table. For example, the pressure of the first stage HPHT process may be about 7.5 GPa to about 10 GPa and the temperature of the HPHT process may be about 1150° C. to about 1450° C. (e.g., about 1200° C. to about 1400° C.). The foregoing pressure values employed in the HPHT process refer to the cell pressure in the pressure transmitting medium that transfers the pressure from the ultra-high pressure press to the assembly.

In an embodiment, during the first stage HPHT process, the at least one Group VIII metal from the substrate 104 or another source (e.g., metal-solvent catalyst mixed with the diamond particles) liquefies and infiltrates into the mass of diamond particles 302 and sinters the diamond particles together to form a PCD table having diamond grains exhibiting diamond-to-diamond bonding (e.g., $sp^3$ bonding) therebetween with the at least one Group VIII metal disposed in the interstitial regions between the diamond grains. In an embodiment, the alloying element from the at least one material 304 does not melt during the first stage HPHT process. Thus, in this embodiment, the at least one alloying element has a melting temperature greater than the at least one Group VIII metal (e.g., cobalt) that is used. For example, if the substrate 104 is a cobalt-cemented tungsten carbide substrate, cobalt from the substrate 104 may be liquefied and infiltrate the mass of diamond particles 302 to catalyze formation of the PCD table, and the cobalt may subsequently be cooled to below its melting point or range.

After sintering the diamond particles to form the PCD table in the first stage HPHT process, in a second stage HPHT process, the temperature is increased from the temperature employed in the first stage HPHT process, while still maintaining application of the same, less, or higher cell pressure to maintain diamond-stable conditions. The temperature of the second stage HPHT process is chosen to partially or completely diffuse/melt the alloying element of the at least one material 304, which then alloys with the at least one Group VIII metal interstitially disposed in the PCD table and forms the final PCD table 102 having the alloy disposed interstitially between at least some of the diamond grains. Optionally, the temperature of the second stage HPHT process may be controlled so that the at least one Group VIII metal is still liquid or partially liquid so that the alloying with the at least one alloying element occurs in the liquid phase, which typically speeds diffusion.

Before or after alloying, the PDC may be subjected to finishing processing to, for example, chamfer the PCD table and/or planarize the upper surface thereof. The temperature of the second stage HPHT process may be about 1500° C. to about 1900° C., and the temperature of the first stage HPHT process may be about 1350° C. to about 1450° C. After and/or during cooling from the second stage HPHT process, the PCD table 102 bonds to the substrate 104. As discussed above, the alloying of the at least one Group VIII metal with the at least one alloying element lowers a melting temperature of the at least one Group VIII metal and at least one of a bulk modulus or coefficient of thermal expansion of the at least one Group VIII metal.

For example, in an embodiment, the at least one material 304 may comprise boron particles, such as boron particles mixed with aluminum oxide particles. In another embodiment, the at least one material 304 may comprise copper or a copper alloy in powder or foil form. In such embodiments, the pressure of the second stage HPHT process may be about 5.5 GPa to about 6.5 GPa cell pressure and the temperature of the second stage HPHT process may be about 1550° C. to about 1650° C. (e.g., 1600° C.), which is maintained for about 1 minutes to about 35 minutes (e.g., about 2 minutes to about 35 minutes, about 2 minutes to about 5 minutes, about 10 to about 15 minutes, about 5 to about 10 minutes, or about 25 to about 35 minutes).

In an embodiment, a second stage HPHT process is not needed. Particularly, alloying may be possible in a single HPHT process. In an example, when the at least one alloying element is copper or a copper alloy, the copper or copper alloy may not always infiltrate the un-sintered diamond particles under certain conditions. For example, after the at least one Group VIII metal has infiltrated (or as it infiltrates the diamond powder) and at least begins to sinter the diamond particles, copper may be able and/or begin to alloy with the at least one Group VIII metal. Such a process may allow materials that would not typically infiltrate diamond powder to do so during or after infiltration by a catalyst.

Figure 3B:
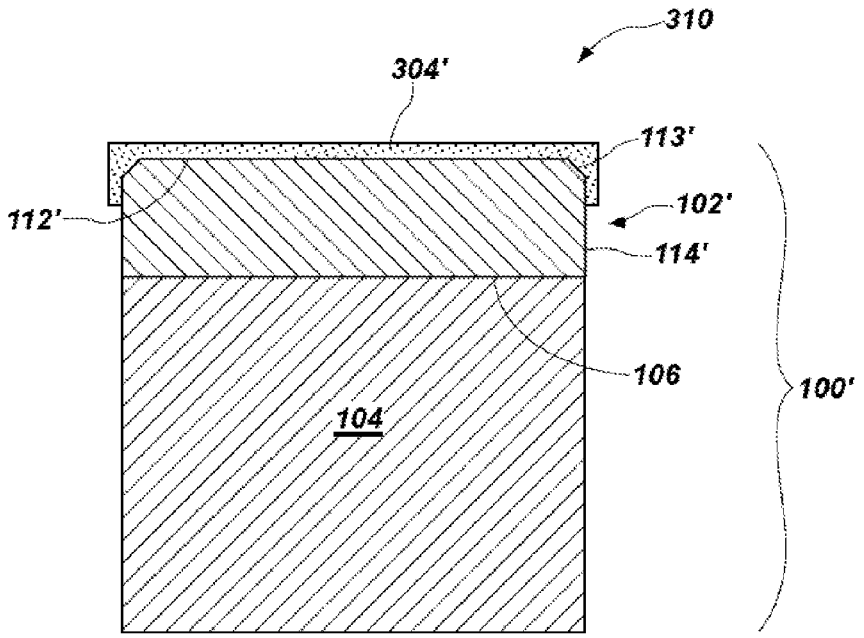
FIGS. 3B-3D is a cross-sectional view of a precursor PDC assembly during the fabrication of the PDC shown in FIGS. 1A and 1B according to another embodiment of a method.

FIG. 3B is a cross-sectional view of a precursor PDC assembly 310 during the fabrication of the PDC 100 shown in FIGS. 1A and 1B according to another embodiment of a method. In this method, a precursor PDC 100' is provided that has already been fabricated and includes a PCD table 102' integrally formed with substrate 104. For example, the precursor PDC 100' may be fabricated using the same HPHT process conditions as the first stage HPHT process discussed above. Additionally, details about fabricating a precursor PDC 100' according to known techniques is disclosed in U.S. Pat. No. 7,866,418, the disclosure of which was previously incorporated by reference. Thus, the PCD table 102' includes bonded diamond grains exhibiting diamond-to-diamond bonding (e.g., $sp^3$ bonding) therebetween, with at least one Group VIII metal (e.g., cobalt) disposed interstitially between the bonded diamond grains.

At least one material 304' of any of the at least one alloying elements (or mixtures or combinations thereof) disclosed herein may be positioned adjacent to an upper surface 112' of the PCD table 102' to form the precursor PDC assembly 310. For example, the at least one material 304' may be in the form of particles of the alloying element(s), a thin disc of the alloying element(s), a green body of particles of the alloying elements(s), or combinations thereof. Although the PCD table 102' is illustrated as being chamfered with a chamfer 113' extending between the upper surface 112' and at least one side surface 114', in some embodiments, the PCD table 102' may not have a chamfer. As the PCD table 102' is already formed, any of the at least one alloying elements disclosed herein may be used, regardless of its melting temperature. The precursor PDC assembly 310 may be subjected to an HPHT process using the same or similar HPHT conditions as the second stage HPHT process discussed above or even lower temperatures for certain low-melting at least one alloying elements, such as bismuth. For example, the temperature may be about 200° C. to about 500° C. for such embodiments. During the HPHT process, the at least one alloying element partially or completely melts/diffuses and alloys with the at least one Group VIII metal of the PCD table 102' which may or may not be liquid or partially liquid depending on the temperature and pressure.

For example, in an embodiment, the at least one material 304' may comprise boron particles. In another embodiment, the at least one material 304 may comprise copper or a copper alloy in powder or foil form. In such embodiments, the pressure of the second stage HPHT process may be about 5.5 GPa to about 6.5 GPa cell pressure and the temperature of the second stage HPHT process may be about 1550° C. to about 1650° C. (e.g., 1600° C.), which is maintained for about 2 minutes to about 35 minutes (e.g., about 10 to about 15 minutes, about 5 to about 10 minutes, or about 25 to about 35 minutes).

In some embodiments, the at least one material 304' of the alloying element may be non-homogenous. For example, the at least one material 304' may include a layer of a first alloying element having a first melting temperature encased/enclosed in a layer of a second alloying element having a second melting temperature greater than the first melting temperature. For example, the first one of the at least one alloying element may be silicon or a silicon alloy and the second one of the at least one alloying element may be zirconium or a zirconium alloy. During the melting of the at least one material 304' (e.g., during the second stage HPHT process), once the second alloying element is completely melted and alloys the at least one Group VIII metal, the first alloying element may escape and further alloy the at least one Group VIII metal of the PCD table. In other embodiments, the first alloying element may diffuse through the layer of the second alloying element via solid state or liquid diffusion to alloy the at least one Group VIII metal.

In other embodiments, a second stage HPHT process may be performed without the use of the alloying element from the at least one material 304'. Such a second stage HPHT process may increase the thermal stability and/or wear resistance of the PCD table even in the absence of the alloying element.

Figure 3C:
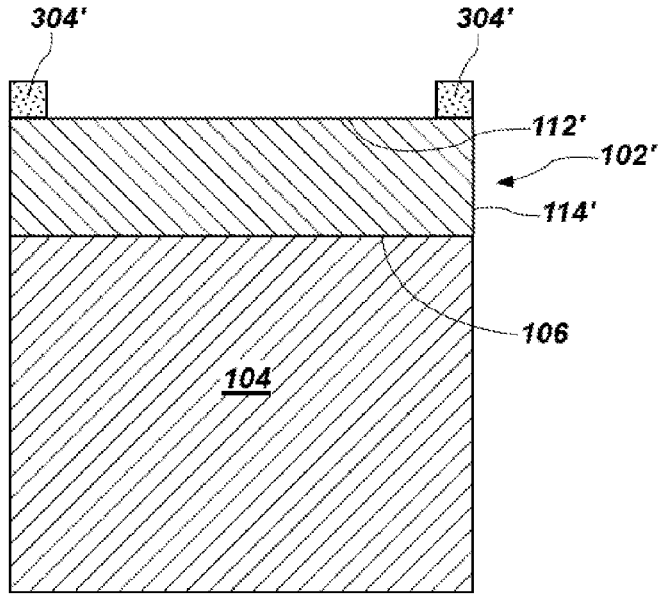
Figure 3D:
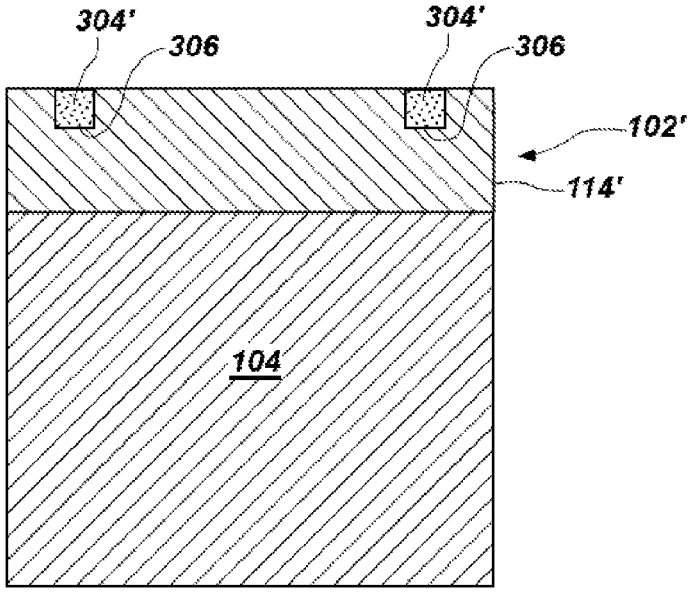
Figure 3E:
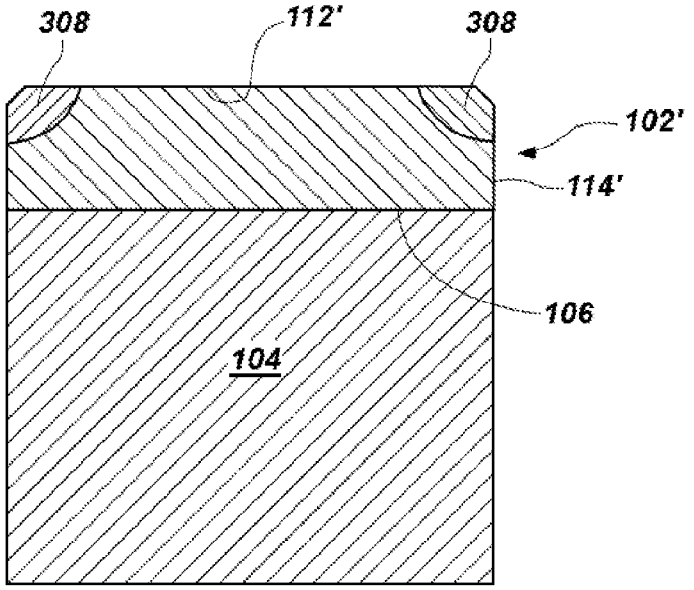
FIG. 3E is a cross-sectional view of an embodiment of a PDC after processing the precursor PDC assembly shown in FIG. 3D.

Referring to FIG. 3C, in another embodiment, the at least one material 304' may be in the form of an annular body so that the at least one alloying element diffuses into the at least one Group VIII metal in selected location(s) of the PCD table 102'. FIG. 3D illustrates another embodiment for diffusing the at least one alloying element into the at least one Group VIII metal in selected location(s) of the PCD table 102'. For example, one or more grooves 306 may be machined in the PCD table 102' such as by laser machining. The at least one material 304' may be preplaced in the one or more grooves 306. FIG. 3E illustrates the resultant structure of the PCD table 102' after the at least one alloying element of the at least one material 304' diffuses into the PCD table 102' to form peripheral region 308 in which the at least one Group VIII metal thereof is alloyed with the at least one alloying element.

Figure 4:
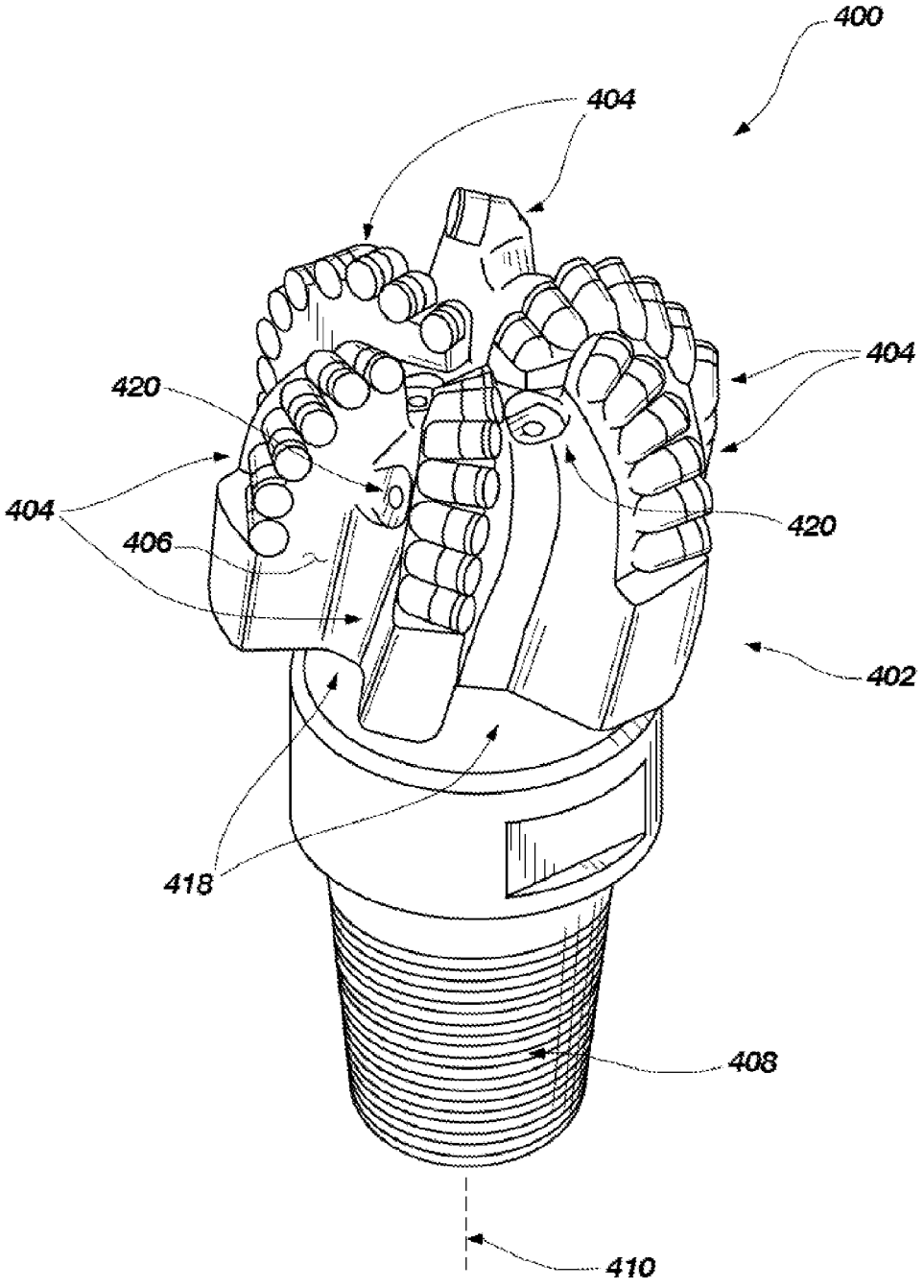
FIG. 4 is an isometric view of an embodiment of a rotary drill bit that may employ one or more of the disclosed PDC embodiments.
Figure 5:
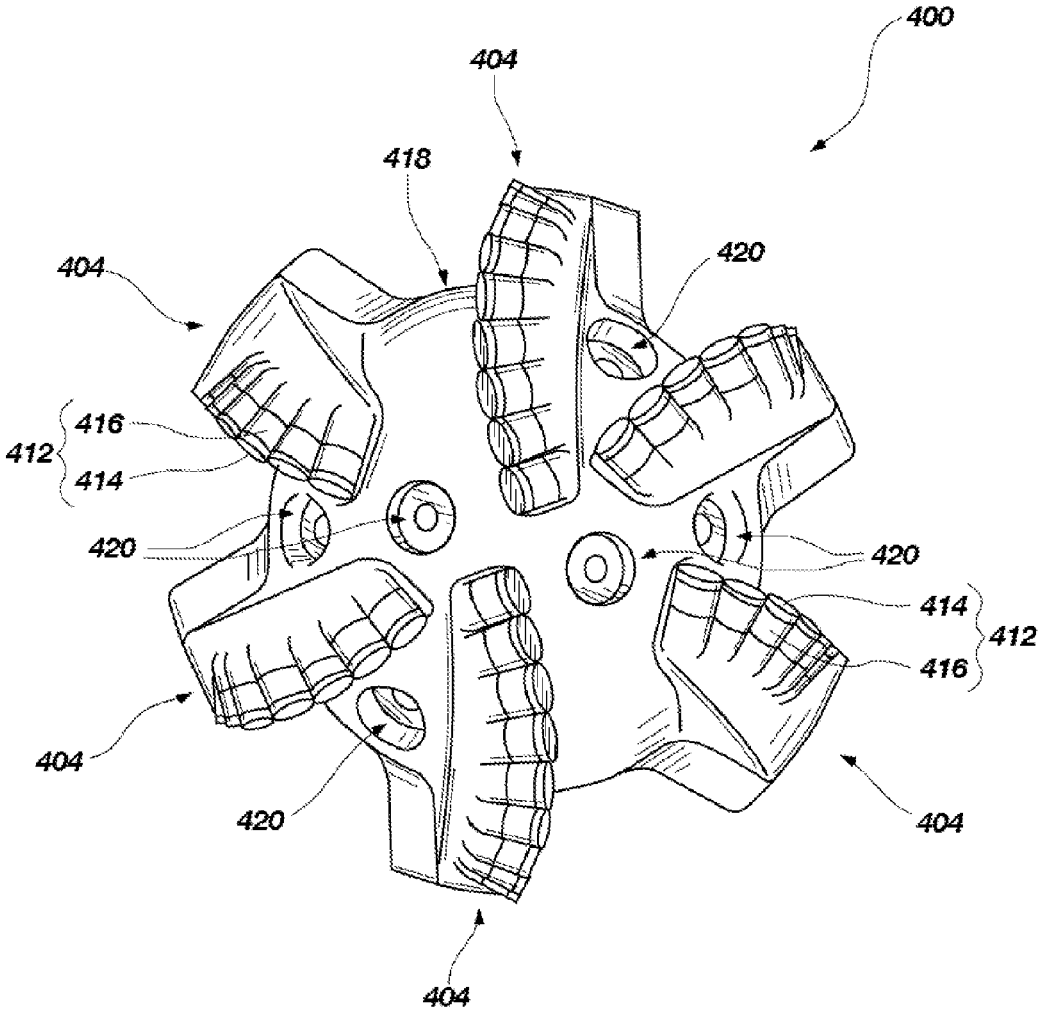
FIG. 5 is a top elevation view of the rotary drill bit shown in FIG. 4.

FIG. 4 is an isometric view and FIG. 5 is a top elevation view of an embodiment of a rotary drill bit 400 that includes at least one PDC configured according to any of the disclosed PDC embodiments. The rotary drill bit 400 comprises a bit body 402 that includes radially and longitudinally extending blades 404 having leading faces 406, and a threaded pin connection 408 for connecting the bit body 402 to a drilling string. The bit body 402 defines a leading end structure for drilling into a subterranean formation by rotation about a longitudinal axis 410 and application of weight-on-bit. At least one PDC, configured according to any of the disclosed PDC embodiments, may be affixed to the bit body 402. With reference to FIG. 5, each of a plurality of PDCs 412 is secured to the blades 404 of the bit body 402 (FIG. 4). For example, each PDC 412 may include a PCD table 414 bonded to a substrate 416. More generally, the PDCs 412 may comprise any PDC disclosed herein, without limitation. In addition, if desired, in some embodiments, a number of the PDCs 412 may be conventional in construction. Also, circumferentially adjacent blades 404 define so-called junk slots 420 therebetween. Additionally, the rotary drill bit 400 includes a plurality of nozzle cavities 418 for communicating drilling fluid from the interior of the rotary drill bit 400 to the PDCs 412.

FIGS. 4 and 5 merely depict one embodiment of a rotary drill bit that employs at least one PDC fabricated and structured in accordance with the disclosed embodiments, without limitation. The rotary drill bit 700 is used to represent any number of earth-boring tools or drilling tools, including, for example, core bits, roller-cone bits, fixed-cutter bits, eccentric bits, bi-center bits, reamers, reamer wings, or any other downhole tool including superabrasive compacts, without limitation.

The PDCs disclosed herein (e.g., PDC 100 of FIGS. 1A and 1B) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used in any apparatus or structure in which at least one conventional PDC is typically used. In one embodiment, a rotor and a stator, assembled to form a thrust-bearing apparatus, may each include one or more PDCs (e.g., PDC 100 of FIGS. 1A and 1B) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing PDCs disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,274,900; 4,268,276; 4,468,138; 4,738,322; 4,913,247; 5,016,718; 5,092,687; 5,120,327; 5,135,061; 5,154,245; 5,460,233; 5,544,713; and 6,793,681, the disclosure of each of which is incorporated herein, in its entirety, by this reference.

WORKING EXAMPLES

The following working examples provide further detail in connection with the specific embodiments described above. Comparative working examples 1 and 2 are compared with working examples 3-5 fabricated according to specific embodiments of the invention.

Comparative Working Example 1

Several PDCs were formed according to the following process. A first layer of diamond particles having an average particle size of about 19 μm was disposed on a cobalt-cemented tungsten carbide substrate. The diamond particles and the cobalt-cemented tungsten carbide substrate were HPHT processed in a high-pressure cubic press at a temperature of about 1400° C. and a cell pressure of about 5.5 GPa to form a PDC comprising a PCD table integrally formed and bonded to the cobalt-cemented tungsten carbide substrate. Cobalt infiltrated from the cobalt-cemented tungsten carbide substrate occupied interstitial regions between bonded diamond grains of the PCD table.

Comparative Working Example 2

Several PDCs were formed according to the process of comparative working example 1. The PCD table was then leached in an acid to substantially remove cobalt therefrom to a depth of greater than 200 μm from an upper surface of the PCD table.

Working Example 3

Several PDCs were formed according to the process of comparative working example 1. Each PDC was then placed in a canister with boron powder positioned adjacent to an upper surface and side surface of the PCD table. The canister and the contents therein were subjected to a second HPHT process at a cell pressure of about 6.5 GPa and a temperature of about 1600° C. for about 30 minutes to alloy the cobalt in the PCD table with boron. The alloyed PCD table was not leached.

One of the PDCs was destructively analyzed using x-ray diffraction ("XRD") to determine the phases present at various depths in the PCD table. The PCD table was subjected to XRD to determine the phases present at a given depth, the PCD table was then ground, and then the grounded PCD table was subjected to XRD to determine the phases present at the different depth. This process was repeated. Table II below shows the approximate depth and the corresponding phases determined via XRD. The XRD data indicated that boron forms several different intermediate compounds with both cobalt, tungsten, and cobalt and tungsten. The concentration of boron decreased with distance from the upper surface of the PCD table. It is notable that despite the presence of boron, that only tungsten carbide was detected and no boron carbide was detected.

TABLE II

| Distance from Upper Surface of PCD Table (in) | Phases Detected by XRD |
|---|---|
| 0.00 | diamond, BCo, $W_2B_5$, Co |
| 0.010 | diamond, $B_2CoW_2$, $Co_2B$, BCo, Co |
| 0.020 | diamond, WC, $BCo_2$, $Co_{21}W_2B_6$, Co |
| 0.030 | diamond, WC, $Co_{21}W_2B_6$, Co |
| 0.040 | diamond, WC, $Co_{21}W_2B_6$, $Co_3W_3C$, Co |
| 0.050 | diamond, WC, $Co_3W_3C$, Co |
| 0.060 | diamond, WC, $Co_3W_3C$, Co |

Working Example 4

Several PDCs were formed according to the process of comparative working example 1. Each PDC was then placed in a canister with a copper foil positioned adjacent to an upper surface of the PCD table. The canister and the contents therein were subjected to a second HPHT process at a cell pressure of about 6.5 GPa and a temperature of about 1600° C. for a about 5 minutes to alloy the cobalt in the PCD table with copper. The alloyed PCD table was not leached.

Copper was detected to a depth of about 0.020 inches from the upper surface of the PCD table using XRD. The inventors currently believe that longer soak times at high temperature will enable more copper to diffuse into cobalt of the PCD table to a greater depth.

Thermal Stability Testing

Figure 6:
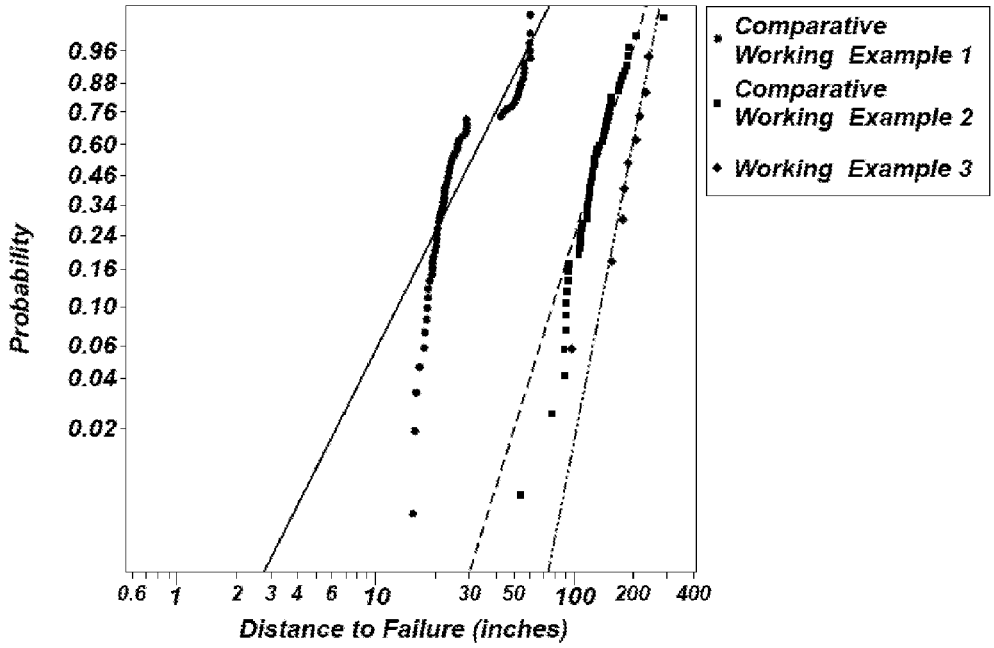
FIG. 6 is a graph of probability to failure versus distance to failure that compared the thermal stability of comparative working examples 1 and 2 with working example 3 of the invention.
Figure 7:
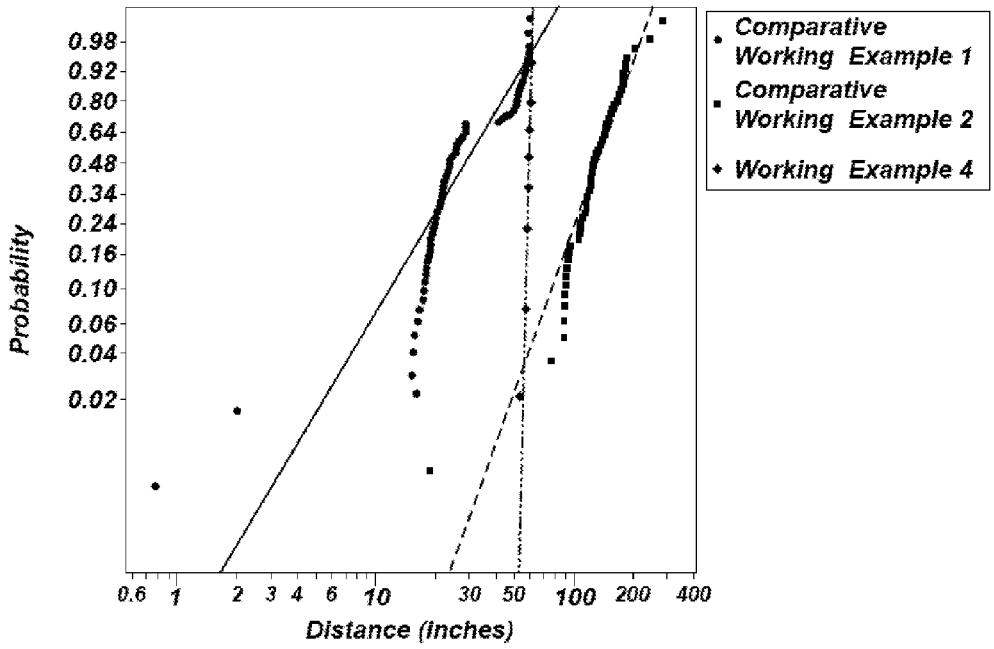
FIG. 7 is a graph of probability to failure versus distance to failure that compared the thermal stability of comparative working examples 1 and 2 with working example 4 of the invention.

Thermal stability testing was performed on the PDCs of working examples 1-4. FIGS. 6 and 7 are graphs of probability to failure of a PDC versus distance to failure for the PDC. The results of the thermal stability testing are shown in FIGS. 6 and 7. FIG. 6 compared the thermal stability of comparative working examples 1 and 2 with working example 3 of the invention. FIG. 7 compared the thermal stability of comparative working examples 1 and 2 with working example 4 of the invention. The thermal stability was evaluated in a mill test in which a PDC is used to cut a Bane granite workpiece. The test parameters used were an in-feed for the PDC of about 50.8 cm/min, a width of cut for the PDC of about 7.62 cm, a depth of cut for the PDC of about 0.762 mm, a rotary speed of the workpiece to be cut of about 3000 RPM, and an indexing in the Y direction across the workpiece of about 7.62 cm. Failure is considered when the PDC can no longer cut the workpiece.

As shown in FIG. 6, working example 3, which was unleached, exhibited a greater thermal stability than even the deep leached PDC of comparative working example 2. The characteristic distance to failure for the non-leached PDC of comparative working example 1 is 36.8 inches (33.2 inches- 40.9 inches, n=91, 95%). The characteristic distance to failure for the deep-leached PDC of comparative working example 2 is 154 inches (143.6 inches-165.1 inches, n=74, 95%). The characteristic distance to failure for the boron diffused non-leached PDC of working example 3 is 208.7 inches (185.5 inches-234.7 inches, n=9, 95%).

As shown in FIG. 7, the thermal stability of the PDC of working example 4 was better than the PDC of comparative working example 1, but not as good as the deep leached PDC of comparative working example 2. The inventors currently believe that longer soak times at high temperature will enable more copper atoms to diffuse into cobalt of the PCD table to a greater depth and improve thermal stability to be comparable to that of the PDC of comparative working example 2. The characteristic distance to failure for a non-leached PDC of comparative working example 1 is 36.8 inches (33.2 inches-40.9 inches, n=91, 95%). The characteristic distance to failure for a deep-leached PDC of comparative working example 2 is 154.0 inches (143.6 inches-165.1 inches, n=74, 95%). The characteristic distance to failure for the copper diffused non-leached PDC of working example 4 is 61.6 inches (60.7 inches-62.6 inches, n=7, 95%).

Working Example 5

A PDC was formed according process of working example 4. The PDC was destructively analyzed using Rietveld XRD analysis to determine the phases present at various depths in the PCD table and the relative weight % of the phases in the PCD table. The PCD table was subjected to Rietveld XRD analysis to determine the phases present at the upper surface of the PCD table and their relative weight %, and the PCD table was then ground at 0.010 inch intervals up to 0.050 inch, and then the ground PCD table was subjected to Rietveld XRD analysis to determine the phases present at the different depths. Table III below shows the approximate depth, and the corresponding phases and relative weight % determined via Rietveld XRD analysis. The Rietveld XRD analysis data indicated that boron forms several different intermediate compounds with both cobalt, tungsten, and cobalt and tungsten. Near the upper surface at a depth 0.0 inch and 0.010 inch, there was a relatively low concentration pure cobalt phase detected. The concentration of boron decreased with distance from the upper surface of the PCD table. It is notable that despite the presence of boron, that only tungsten carbide was detected and no boron carbide was detected with this test sample too.

TABLE III

| Distance from Upper Surface of PCD Table (in) | Phases Detected by XRD (Weight % of Each Phase Below) | | | | | |
|---|---|---|---|---|---|---|
| 0.00 | diamond | $WB_{2.5}$ | CoB | cobalt | | |
| | 92.3 | 1.57 | 5.57 | 0.57 | | |
| 0.010 | diamond | $CoW_2B_2$ | CoB | $Co_2B$ | cobalt | |
| | 92.3 | 1.97 | 4.44 | 0.66 | 0.61 | |
| 0.020 | diamond | WC | $Co_{21}W_2B_6$ | $Co_2B$ | CoWB | cobalt |
| | 93.2 | 0.682 | 2.65 | 2.62 | 0.66 | 0.23 |
| 0.030 | diamond | WC | $Co_{21}W_2B_6$ | cobalt | | |
| | 83.0 | 0.66 | 16 | 0.20 | | |
| 0.040 | diamond | WC | $Co_{21}W_2B_6$ | $Co_3W_3C$ | cobalt | |
| | 88 | 0.68 | 8.6 | 0.22 | 2.8 | |
| 0.050 | Diamond | WC | $Co_3W_3C$ | cobalt | | |
| | 92.8 | 0.943 | 0.80 | 5.42 | | |

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall have the same meaning as the word "comprising" and variants thereof (e.g., "comprise" and "comprises").

What is claimed is:

1. A polycrystalline diamond compact, comprising:

a substrate; and a polycrystalline diamond table including an upper surface spaced from an interfacial surface that is bonded to the substrate, the polycrystalline diamond table including a plurality of diamond grains defining a plurality of interstitial regions, the polycrystalline diamond table further including an alloy comprising at least one Group VIII metal and at least one metallic alloying element that lowers a temperature at which melting of the at least one Group VIII metal begins, the alloy including one or more solid solution phases comprising the at least one Group VIII metal and the at least one metallic alloying element and one or more intermediate compounds comprising the at least one Group VIII metal and the at least one metallic alloying element, the alloy being disposed in at least a portion of the plurality of interstitial regions, the at least one metallic alloying element exhibiting a concentration gradient between the upper surface and the interfacial surface that generally decreases with distance from the upper surface, the plurality of diamond grains and the alloy of at least a portion of the polycrystalline diamond table collectively exhibiting a coercivity of about 115 Oersteds or more;

wherein the at least one metallic alloying element includes at least one element selected from the group consisting of silver, gold, aluminum, antimony, bismuth, boron, cerium, chromium, copper, dysprosium, erbium, gallium, germanium, gadolinium, hafnium, holmium, indium, lanthanum, magnesium, manganese, molybdenum, niobium, neodymium, praseodymium, platinum, ruthenium, sulfur, antimony, scandium, selenium, silicon, samarium, tin, tantalum, terbium, tellurium, thorium, titanium, vanadium, yttrium, zinc, and zirconium.

2. The polycrystalline diamond compact of claim 1 wherein the polycrystalline diamond table is integrally formed with the substrate.

3. The polycrystalline diamond compact of claim 1 wherein the at least one metallic alloying element is distributed substantially uniformly throughout the polycrystalline diamond table.

4. The polycrystalline diamond compact of claim 1 wherein the alloy exhibits a bulk modulus that is less than that of the at least one Group VIII metal alone.

5. The polycrystalline diamond compact of claim 1 wherein the at least one metallic alloying element includes at least one additional element selected from the group consisting of iron, and tungsten.

6. The polycrystalline diamond compact of claim 1 wherein the at least one element is selected from the group consisting of boron and copper.

7. The polycrystalline diamond compact of claim 1 wherein the at least one element is boron.

8. The polycrystalline diamond compact of claim 1 wherein the at least one is copper.

9. The polycrystalline diamond compact of claim 1 wherein the at least one metallic alloying element is present in the alloy in an amount of a eutectic composition, a hypo-eutectic composition, or a hyper-eutectic composition of the at least one Group VIII metal and the at least one alloying element.

10. The polycrystalline diamond compact of claim 1 wherein the at least one element is boron, and wherein the at least one Group VIII metal includes cobalt.

11. The polycrystalline diamond compact of claim 10 wherein the alloy includes $Co_{21}W_2B_6$.

12. The polycrystalline diamond compact of claim 1 wherein the at least one element is boron and is substantially free of boron carbide.

13. The polycrystalline diamond compact of claim 1 wherein the one or more intermediate compounds are present in an amount of about 90 weight % to about 97 weight % of the alloy.

14. The polycrystalline diamond compact of claim 1 wherein the coercivity is about 115 Oersteds to about 250 Oersteds.

15. The polycrystalline diamond compact of claim 1 wherein the at least a portion of the polycrystalline diamond table exhibiting a specific magnetic saturation of about 15 Gauss $cm^3$/grams or less.

16. The polycrystalline diamond compact of claim 1 wherein the plurality of diamond grains exhibit an average grain size of 30 μm or less, and wherein the alloy is present in an amount of 1 weight % to about 7.5 weight %.

17. The polycrystalline diamond compact of claim 1 wherein the plurality of diamond grains exhibit an average grain size of 20 μm or less, and wherein the alloy is present in an amount of 1 weight % to about 7.5 weight %.

18. The polycrystalline diamond compact of claim 1 wherein the substrate provides the at least one Group VIII metal to the PCD table as indicated by a depletion zone of the at least one Group VIII metal in the substrate adjacent to the PCD table.

19. A polycrystalline diamond compact, comprising:

a substrate; and a polycrystalline diamond table including an upper surface spaced from an interfacial surface that is bonded to the substrate, the polycrystalline diamond table including a plurality of diamond grains defining a plurality of interstitial regions, the polycrystalline diamond table further including an alloy comprising at least one Group VIII metal and at least one Group V element, the alloy being disposed in at least a portion of the plurality of interstitial regions, the at least one Group V element exhibiting a concentration gradient between the upper surface and the interfacial surface that generally decreases with distance from the upper surface, the plurality of diamond grains and the alloy of at least a portion of the polycrystalline diamond table collectively exhibiting a coercivity of about 115 Oersteds or more.

20. The polycrystalline diamond compact of claim 19 wherein the polycrystalline diamond table is integrally formed with the substrate.

21. The polycrystalline diamond compact of claim 19 wherein the at least one Group V element is distributed substantially uniformly throughout the polycrystalline diamond table.

22. The polycrystalline diamond compact of claim 19 wherein the alloy exhibits a bulk modulus that is less than that of the at least one Group VIII metal alone.

23. The polycrystalline diamond compact of claim 19 wherein the at least one Group V element includes at least one element selected from the group consisting of antimony and bismuth.

24. The polycrystalline diamond compact of claim 23 wherein the at least one Group V element is antimony.

25. The polycrystalline diamond compact of claim 23 wherein the at least one Group V element is bismuth.

26. The polycrystalline diamond compact of claim 19 wherein the alloy includes one or more intermetallic compounds of the at least one Group VIII metal and the at least one Group V element.

27. The polycrystalline diamond compact of claim 26 wherein the one or more intermetallic compounds are present in an amount of about 90 weight % to about 97 weight % of the alloy.

28. The polycrystalline diamond compact of claim 19 wherein the coercivity is about 115 Oersteds to about 250 Oersteds.

29. The polycrystalline diamond compact of claim 19 wherein the at least a portion of the polycrystalline diamond table exhibiting a specific magnetic saturation of about 15 Gauss·$cm^3$/grams or less.

30. The polycrystalline diamond compact of claim 19 wherein the plurality of diamond grains exhibit an average grain size of 30 μm or less, and wherein the alloy is present in an amount of 1 weight % to about 7.5 weight %.

31. The polycrystalline diamond compact of claim 19 wherein the plurality of diamond grains exhibit an average grain size of 20 μm or less, and wherein the alloy is present in an amount of 1 weight % to about 7.5 weight %.

32. The polycrystalline diamond compact of claim 19 wherein the at least one Group VIII metal includes at least one of iron, nickel, or cobalt.

33. A polycrystalline diamond compact, comprising:

a substrate; and a polycrystalline diamond table including an upper surface spaced from an interfacial surface that is bonded to the substrate, the polycrystalline diamond table including a plurality of diamond grains defining a plurality of interstitial regions, the polycrystalline diamond table further including an alloy disposed in at least a portion of the plurality of interstitial regions, the alloy including:

one or more solid solution phases comprising cobalt and boron; and one or more intermediate compounds comprising cobalt and boron;

wherein the boron exhibits a concentration gradient between the upper surface and the interfacial surface of the polycrystalline diamond table, wherein the concentration gradient of the boron decreases with distance from the upper surface;

wherein the plurality of diamond grains and the alloy of at least a portion of the polycrystalline diamond table collectively exhibit a coercivity of about 115 Oersteds or more.

34. The polycrystalline diamond compact of claim 33 wherein the alloy includes $Co_{21}W_2B_6$.

35. The polycrystalline diamond compact of claim 33 wherein the alloy is substantially free of boron carbide.

36. The polycrystalline diamond compact of claim 33 wherein the one or more intermetallic compounds are present in an amount of about 90 weight % to about 97 weight % of the alloy.

37. A polycrystalline diamond compact, comprising:

a substrate; and a polycrystalline diamond table including an upper surface spaced from an interfacial surface that is bonded to the substrate, the polycrystalline diamond table including a plurality of diamond grains defining a plurality of interstitial regions, the polycrystalline diamond table further including an alloy comprising at least one Group VIII metal and at least one metallic alloying element that lowers a temperature at which melting of the at least one Group VIII metal begins, the alloy including one or more solid solution phases comprising the at least one Group VIII metal and the at least one metallic alloying element and one or more intermediate compounds comprising the at least one Group VIII metal and the at least one metallic alloying element, the alloy being disposed in at least a portion of the plurality of interstitial regions, the plurality of diamond grains and the alloy of at least a portion of the polycrystalline diamond table collectively exhibiting a coercivity of about 115 Oersteds or more;

wherein the one or more intermediate compounds forms about 90 weight % to about 97 weight % of at least a portion of the alloy.

* * * * *